United States Patent [19]

Le Caer et al.

[11] Patent Number: 4,710,246

[45] **Date of Patent: * Dec. 1, 1987**

[54] AMORPHOUS ALUMINUM-BASED ALLOYS

[75] Inventors: Gerard Le Caer, Nancy; Jean-Marie Dubois, Pompey, both of France

[73] Assignee: Centre National de la Recherche Scientifique "CNRS", Paris, France

[ * ] Notice: The portion of the term of this patent subsequent to Jun. 17, 2003 has been disclaimed.

[21] Appl. No.: 655,167

[22] Filed: Sep. 27, 1984

Related U.S. Application Data

[63] Continuation-in-part of Ser. No. 506,993, Jun. 23, 1983, Pat. No. 4,595,429.

[30] Foreign Application Priority Data

Jul. 6, 1982 [FR] France ..... 82 12404

[51] Int. Cl.[4] ..... C22C 21/00

[52] U.S. Cl. ..... 148/403; 148/437; 148/438; 148/439; 148/440

[58] Field of Search ..... 420/528; 148/403, 437, 148/438, 439, 440

[56] References Cited

U.S. PATENT DOCUMENTS 4,347,076 8/1982 Ray et al. ..... 148/437

4,595,429 6/1986 Le Caer et al. ..... 148/403

*Primary Examiner*—R. Dean

*Attorney, Agent, or Firm*—Oblon, Fisher, Spivak, McClelland & Maier

[57] ABSTRACT

A substantially amorphous or microcrystalline Al-based alloy, wherein said Al-based alloy is represented by the formula:

$$Al_aM_bM'_cX_dY_e$$

in which:

$a+b+c+d+e=100$ $50 \leqq a \leqq 95$ atom %

$0 \leqq b \leqq 40$ atom %

$0 \leqq c \leqq 15$ atom %

$0 \leqq d \leqq 20$ atom %

$0 \leqq e \leqq 3$ atom % wherein at least two of the subscripts b, c or d are strictly positive, and wherein M is at least one metal selected from the group consisting of Mn, Ni, Cu, Zr, Cr, Ti, V, Fe and Co; M' is Mo, W, or a mixture thereof, X is at least one element selected from the group consisting of Ca, Li, Mg, Ge, Si, and Zn; and Y is the inevitable production impurities, with the proviso that when element M is Co, Mn and/or Ni, the total amount of these elements is at least 12 wt % of the alloy.

2 Claims, 4 Drawing Figures

AMORPHOUS ALUMINUM-BASED ALLOYS

CROSS REFERENCE TO RELATED APPLICATION

This application is a continuation-in-part of application Ser. No. 506,993 filed June 23, 1983, U.S. Pat. No. 4,595,429.

BACKGROUND OF THE INVENTION

Field of the Invention

The invention relates to substantially amorphous or microcrystalline Al-based alloys.

There are many alloys in an amorphous state, which are produced by rapid cooling at a rate which is generally higher than $10^{5}$° C./sec from a random state (liquid or vapor). In particular, alloys of type $T_iX_j$ are known, in which T represents one or more transition metals (in particular iron) and X represents one or more metalloids (non-metalloids) such as B, P, Si, C, Al, with $i \geqq 50$ atom %. In such alloys, Al occurs as a minor element, the proportion of which, generally of the order of 10 atom %, does not exceed 35 atom %.

For Al-based alloys (containing more than 50 atom % Al), the technical literature reports on attempts to produce amorphous alloys, which were carried out in relation to binary alloys containing Bi, Cd, Cu, Ge, In, Mg, Ni, Pd, Si, Cr, Ag or Zn, but only four of them, Al-Ge, Al-Pd, Al-Ni, Al-Cr were found to be very locally amorphous (regions which are visible in electron microscopy), and that occurs with very high rates of cooling of the order of $10^9$ to $10^{10}$ K/sec, which are very difficult to attain on an industrial scale: see T. R. Anantharaman et al. "Rapidly Quenched Metals III", volume 1, Editor B. Cantor, The Metals Society, London (1978) page 126 and P. Furrer and Warlimont, Mat. Science and Eng., 28 (1977) page 127.

With regard to ternary alloys, amorphous alloys were produced by A. Inoue et al., (Journal of Mat. Science 16, 1981, page 1895) but they relate to the systems (Fe, Co, Ni)-AL-B, which may contain up to 60 atom % Al and generally from 15 to 45–50 atom % B.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

SUMMARY OF THE INVENTION

Figure 1A:
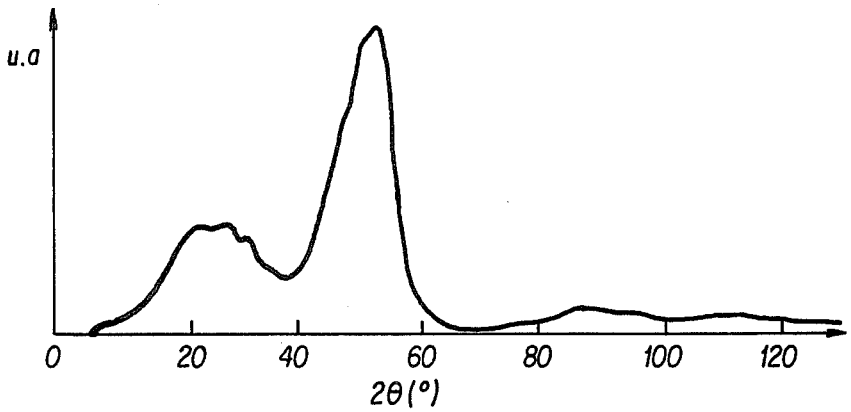
FIG. 1*a* shows the diagram of the amorphous alloy, FIG. 1*b* being a part of the FIG. 1*a* diagram on an enlarged scale.
Figure 1B:
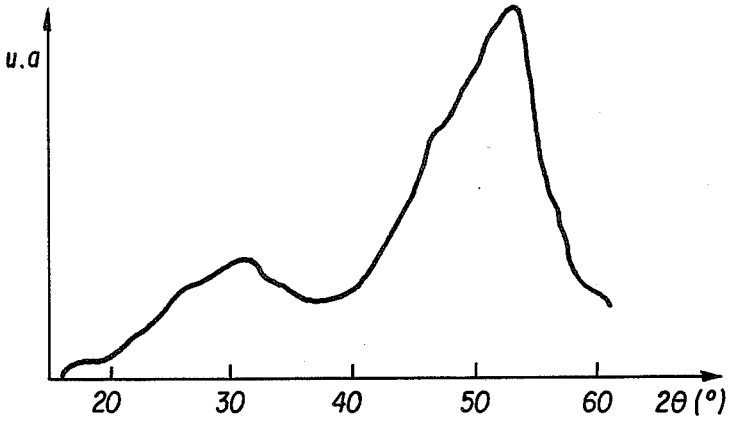
FIG. 1 shows the X-ray diagram of an alloy $Al_{80}Cu_{10}Ni_8Mo_2$, which is produced by means of monochromatic radiation of Co ($\lambda$=0.17889 nm)
FIG. 1*c* shows the diffraction diagram of the corresponding crystallized alloy.
Figure 1C:
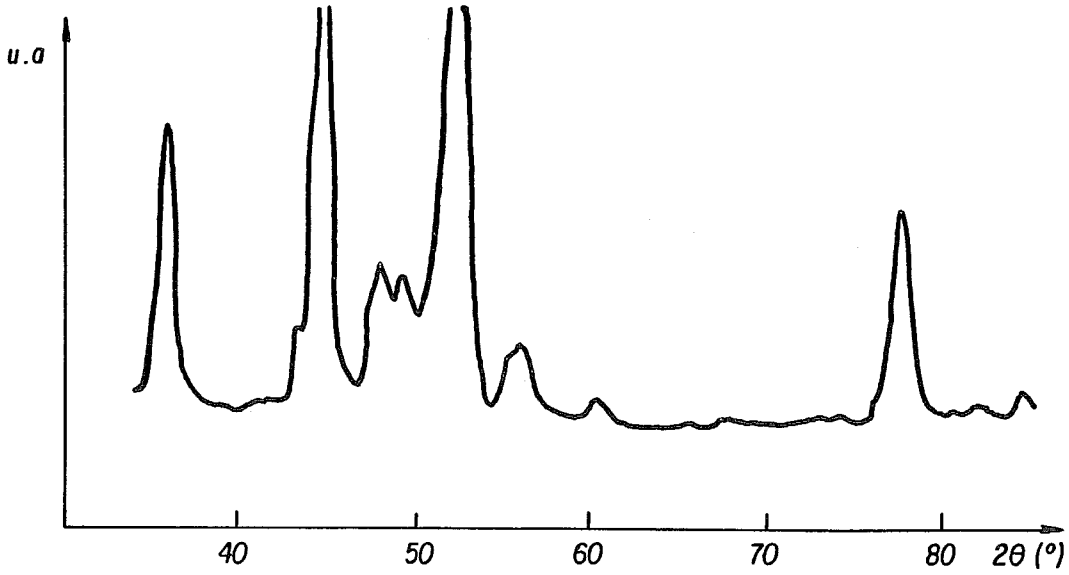

The invention therefore concerns alloys based on Al, free from boron, which can be produced in a substantially amorphous or microcrystalline state, by cooling at rates of the order of $10^5$ to $10^6$ K/sec, which can be attained on an industrial scale, from a liquid or gaseous state.

The expression substantially amorphous alloy is used to denote a state in which the atoms are not in any order at a great distance, characterized by broad and diffuse X-ray diffraction spectra, without characteristic lines of the crystallized state; corresponding electron microscope investigations show that more than 80% by volume of the alloy is amorphous.

The expression microcrystalline state is used to denote an alloy in which 20% of the volume or more is in a crystallized state and in which the mean dimension of the crystallites is less than 1000 nm, preferably less than 100 nm (1000 Å). Said mean dimension is evaluated from the mid-height width of the line of the dense planes of the alloy, or by electron microscopy (in the black field). In that state, the diffraction lines at low angles ($\theta < 22°$) have disappeared.

The microcrystalline alloys are generally produced either directly from the liquid state or by thermal crystallization treatment above the initial crystallization temperature Tc of the amorphous alloy (that is determined hereinafter by differential enthalpic analysis, with a heating rate of 10° C./min). The alloys according to the invention have the following chemical composition, defined by the formula:

$$Al_aM_bM'_cX_dY_e$$

in which:

$$50 \leqq a \leqq 95 \text{ atom \%}$$

M represents one or more metals of the group Mn, Ni, Cu, Zr, Ti, V, Cr, Fe, and Co with $$0 \leqq b \leqq 40 \text{ atom \%}$$

M′ representing Mo and/or W with $$0 \leqq c \leqq 15 \text{ atom \%}$$

X represents one or more elements of the group Ca, Li, Mg, Ge, Si, Zn with $$0 \leqq d \leqq 20 \text{ atom \%, and}$$

Y represents the inevitable production impurities such as O, N, C, H, He, Ga, etc., the total proportion of which does not exceed 3 atom %, in particular for the lightest elements, but which are preferably held at a level below 1 atom %. The scope of the invention is further modified by the limitation that when M is Co, Mn and/or Ni, the total amount of these elements in the alloy is at least 12 wt. %, and that the value of at least two of the subscripts b, c and d are strictly positive.

DETAILED DESCRIPTION OF THE PREFERRED EMBODIMENTS

The proportion of additional elements is limited in an upward direction by virtue of metallurgical considerations (melting temperature, viscosity, surface tension, oxidizability, etc) but also in consideration of economic factors (price and availability). The Mo and W are limited to 15% as they substantially increase the density and the melting point of the alloy.

It has been found that it is easier to produce a substantially amorphous or microcrystalline alloy if the proportion of Al is limited in an upward direction to 85 atom %.

Substantially amorphous or microcrystalline alloys were produced with alloys containing between 6 and 25 atom % of Cu, with a value of $15 \leqq b \leqq 40$ atom %, with the level of impurities being held at less than 1 atom %.

Preferred compositions comprise individually or in combination, from 0.5 to 5 atom % Mo, from 0.5 to 9 atom % Si, from 5 to 25 atom % V and 7 to 25 atom % Ni.

Having generally described this invention, a further understanding can be obtained by reference to certain specific examples which are provided herein for purpose of illustration only and are not intended to be limiting unless otherwise specified.

EXAMPLES

Example 1

Various alloys were poured in a helium atmosphere at 30 kPa (0.3 bar) from a liquid bath in a quartz crucible, on to the outside of a mild steel drum with a diameter of 25 cm, rotating at a speed of 3000 rpm ($V \simeq 40$ m/sec), so as to produce a strip measuring 2 mm × 20 μm in cross-section.

The results of micro-hardness and/or X-ray study obtained thereon are set out in Table I below.

Example 2

Figure 2:
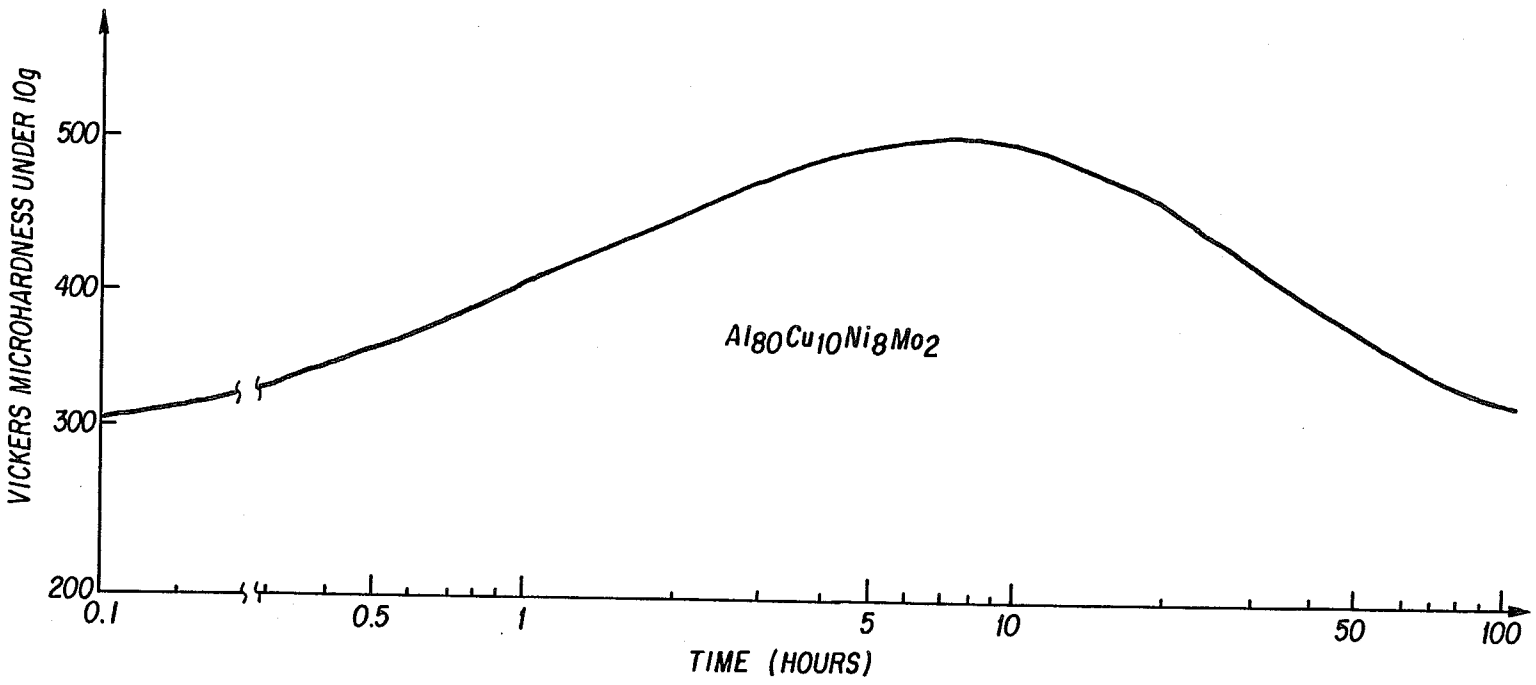
FIG. 2 shows the variation in hardness of the amorphous alloy according to the invention, versus time, when maintained at a temperature of 150° C.

The alloy $Al_{80}Cu_{10}Ni_8Mo_2$ produced above, which has a crystallization temperature Tc = 156° C. and a density of 3.7 g/cm$^3$, and with a ratio in respect of electrical resistance in the amorphous state, relative to resistance in the crystallized state, at 300° K., of 7, was held at a temperature of 150° C.; FIG. 2 shows the variation in Vickers micro-hardness, under 10 g, in that test: it reaches about 500 HV, after 10 hours.

Example 3

The alloy $Al_{72}Cu_{15}V_{10}Mo_1Si_2$ prepared as in Example 1 has a crystallization temperature of 360° C. and a density of 3.6 g/cm$^3$. Its micro-hardness reaches 750 HV after being held at 400° C. for half an hour and 840 HV after being held at 450° C. for half an hour.

The very high levels of hardness are advantageous with regard to producing powders with a very high level of chemical homogeneity, by crushing.

The alloys according to the invention may be produced using known methods, in the form of wires, strips, bands, sheets or powders in the amorphous state and/or in the microcrystallized state. They may be used either directly or as means for reinforcing other materials or they may also be used for producing surface coatings for enhancing corrosion or wear resistance.

TABLE I

| COMPOSITION | POURING TEMPERATURE (°C.) | VICKERS MICRO-HARDNESS UNDER 10 g | STATE x |
|---|---|---|---|
| $Al_{72}Cu_{15}V_{10}Mo_1Si_2$ | 1140 | 500 | A |
| $Al_{80}Cu_9Ni_7Mo_1Si_3$ | 850 | 400 | A |
| $Al_{75}Cu_{12}Ni_{10}Mo_1Si_2$ | 850 | 260 | A |
| $Al_{75}Cu_{11}Ni_9Mo_2Si_3$ | 850 | 220–410 | A |
| $Al_{70}Cu_{13}Ni_{11}Mo_3Si_3$ | 850 | 490 | A |
| $Al_{65}Cu_{16}Ni_{12}Mo_3Si_4$ | 850 | 410 | A |
| $Al_{80}Cu_{10}Ni_8Mo_2$ | 850 | 310–360 | A |
| $Al_{60}Cu_{21}V_{14}Mo_2Si_3$ | 1300 | — | A |
| $Al_{77}Cu_{12}V_8Mo_1Si_2$ | — | — | A |
| $Al_{85}Cu_8V_5Mo_1Si_1$ | — | — | A |
| $Al_{80}Cu_{10}V_7Mo_1Si_2$ | — | — | A |

TABLE I-continued

| COMPOSITION | POURING TEMPERATURE (°C.) | VICKERS MICRO-HARDNESS UNDER 10 g | STATE x |
|---|---|---|---|
| $Al_{65}Cu_{18}V_{12}Mo_2Si_3$ | — | — | m |
| $Al_{72}Cu_{10}V_{14.5}Mo_1Si_{2.5}$ | — | — | m |
| $Al_{69}Cu_{17}Fe_{10}Mo_1Si_3$ | — | — | m |
| $Al_{72}Cu_{16.5}Fe_8Mo_1Si_{2.5}$ | — | — | m |
| $Al_{75}Cu_{14}Fe_7Mo_1Si_3$ | — | — | m |
| $Al_{78}Cu_{12}Fe_6Mo_1Si_3$ | — | — | m |
| $Al_{77}Cu_{12}Zr_8Mo_1Si_2$ | 1250 | 400 | A–m |
| $Al_{77}Cu_{12}Ti_8Mo_1Si_2$ | 1100 | 420 | A–m |
| $Al_{81}Cu_{12}Ni_7$ | 850 | — | A–m |
| $Al_{80}Cu_{10}Ni_8Mo_{0.5}Si_{1.5}$ | 850 | 280 | A–m |
| $Al_{80}Mn_{18}Mo_2$ | 960 | 550 | m |
| $Al_{85}Cu_{12}Si_5$ | 850 | — | m |
| $Al_{83}Cu_8Ni_4Si_5$ | 850 | — | m |
| $Al_{77}Cu_{11}Ni_6Si_6$ | 850 | 250 | m |
| $Al_{78}Cu_{12}Mo_2Si_8$ | 850 | 320 | m |
| $Al_{80}Cu_{10}Mn_8Mo_2$ | 930 | — | m |
| $Al_{85}Cu_7Ni_5Mo_1Si_2$ | 850 | 490 | m |
| $Al_{77}Cu_{12}Cr_8Mo_1Si_2$ | 850 | 540 | m |
| $Al_{77}Cu_{12}Mn_8Mo_1Si_2$ | 850 | 390 | m |
| $Al_{83}Cu_{17}$ | 800 | — | m |
| $Al_{75}Cu_{13}Ni_{10}Mo_2$ | 930 | — | m |
| $Al_{97}Ni_3$ | 850 | — | M |

xA: amorphous - m: microcrystalline - M = macrocrystalline

Having now fully described this invention, it will be apparent to one of ordinary skill in the art that many changes and modifications can be made thereto without departing from the spirit or scope of the invention as set forth herein.

What is claimed as new and is intended to be secured by Letters Patent is:

1. A substantially amorphous Al-based alloy, wherein said Al-based alloy is represented by the formula:

$$Al_aM_bM'_cX_dY_e$$

in which:

$a+b+c+d+e=100$
$50 \leqq a \leqq 95$ atom %
$0 \leqq b \leqq 40$ atom %
$0 \leqq c \leqq 15$ atom %
$0 \leqq d \leqq 20$ atom %
$0 \leqq e \leqq 3$ atom % wherein at least two of the subscripts b, c or d are strictly positive, and wherein M is at least one metal selected from the group consisting of Mn, Ni, Cu, Zr, Cr, Ti, V, Fe and Co;

M' is Mo, W, or a mixture thereof

X is at least one element selected from the group consisting of Ca, Li, Mg, Ge, Si, and Zn; and Y is the inevitable production impurities, with the proviso that when element M is Co, Mn and/or Ni, the total amount of these elements is at least 12 wt % of the alloy.

2. A substantially amorphous Al-based alloy, wherein the said Al-based alloy is represented by the formula:

$$Al_aM_bM'_cX_dY_e$$

in which:

$a+b+c+d+e=100$;
$50 \leqq a \leqq 85$ atom %;
$0 \leqq b \leqq 40$ atom %;
$0 \leqq c \leqq 15$ atom %;
$0 \leqq d \leqq 20$ atom %;

$0 \leqq e \leqq 3$ atom % wherein at least two of the subscripts b, c or d are strictly positive, and wherein M is at least one metal selected from the group consisting of Mn, Ni, Cu, Zr, Cr, Ti, V, Fe and Co;

M′ is Mo, W, or a mixture thereof;

X is at least one element selected from the group consisting of Ca, Li, Mg, Ge, Si, and Zn; and Y is the inevitable production impurities, with the proviso that when element M is Co, Mn or Ni, the total amount of these elements is at least 12 weight % of the alloy.

* * * * *